US005846266A

United States Patent [19]

Rattee

[11] Patent Number: 5,846,266

[45] Date of Patent: Dec. 8, 1998

[54] FABRIC PRINTING

[76] Inventor: Ian Durham Rattee, 35 South Drive, Harrogate HG28AT N. Yorks, England

[21] Appl. No.: 725,697

[22] Filed: Oct. 3, 1996

[30] Foreign Application Priority Data

Oct. 3, 1995 [GB] United Kingdom ..... 9520148
Mar. 6, 1996 [GB] United Kingdom ..... 9604738

[51] Int. Cl.[6] ..... D06P 5/15

[52] U.S. Cl. ..... 8/457; 8/585; 8/597; 8/599; 8/604; 8/618; 8/619; 8/629; 8/637.1

[58] Field of Search ..... 8/457, 486, 629, 8/619, 618, 637.1, 604, 597, 599, 585

[56] References Cited

U.S. PATENT DOCUMENTS 4,400,174 8/1983 Blum et al. ..... 8/456
5,022,891 6/1991 Mc Bride ..... 8/457

FOREIGN PATENT DOCUMENTS 719089 11/1954 United Kingdom .
939515 10/1963 United Kingdom .
1026236 4/1966 United Kingdom .

*Primary Examiner*—Margaret Einsmann
*Attorney, Agent, or Firm*—Darby & Darby

[57] ABSTRACT

By using printing pastes containing thiourea dioxide together with finely dispersed calcium, magnesium or zinc hydroxide, present in the paste as such or generated from components in the printing paste during a treatment process, fabric discharge printing processes may be developed which have the advantage of decorating fabric webs, garments or garment panels effectively, even in dry heat conditions, whilst avoiding contamination of such fabrics with undesirable residues, particularly formaldehyde.

15 Claims, No Drawings

FABRIC PRINTING

FIELD OF THE INVENTION

This invention relates to the printing of fabrics and improvements therein.

BACKGROUND TO THE INVENTION

There are many occasions in which it is desired to produce a pattern or design on fabrics other than by weaving or knitting a pattern or design into them by using threads of different colours. The method by which this aim is most often achieved is by the use of a printing process of one kind or another.

An important variant of textile printing is the process of discharge printing whereby a suitably dyed fabric is printed with a suitable printing ink which contains a chemical (or chemicals) capable of destroying the chromogenic system of the dyes under appropriate conditions, usually heating or steaming. This destruction of the ground colour of the fabric provides a coloured fabric with a design of substantially uncoloured material. In an important variant of the process the printing ink additionally may contain colouring materials which are resistant to the chromogen destroying reactions of discharging and also a means of fixing such colouring materials to the fabric under the physical conditions of discharging. Such so-called "illuminated" discharge prints generally are produced using vat dyes or resin bonded pigments as colouring materials.

It is observed that throughout this specification the term "colouring materials" is used to indicate a pigment or a dyestuff which will give a coloured effect, and the term is used to include both black and white as well as spectral colours. The chemicals used substantially to destroy the colouring materials in discharge printing processes will hereinafter be referred to as "discharging agents".

A variety of procedures are known for achieving discharge printing of fabrics.

Discharge printing processes have been described in which a dyed fabric, usually cotton or some other cellulosic or substantially cellulosic material, is printed with a colouring material containing a discharging agent and dried. At this stage, little or no discharge effect may be seen. The dried print is then steamed at, typically, 102°–104° C. for several minutes, during which time the discharge reactions proceed. The fabric is then washed off, dried and processed further if required.

EP-A-0036252 describes a process of decorating dyed fabric which is printed with a first colouring material containing a discharging agent and then dried to fix it to the fabric. A second colouring material is also applied, before or after the first. The first prevents some of the dye in the second from becoming fixed to the fabric. It is necessary to wash off the fabric to remove such dye as has been prevented from fixing, before the effects of the process are visible.

EP-A-0416888 describes a process of decorating a dyed fabric where the fabric is printed with a colouring material which contains a discharging agent and also an unusually high concentration of humectant. The fabric is heated between impermeable layers at a high enough temperature to produce localised superheated steam from the water in the printing ink to promote the discharge reactions. This procedure has the advantage that the heat treatment is shorter and produces the discharge design within a short time of printing, thus allowing early inspection of the print quality. Printing ink formulations can also be devised for this procedure which permit the final washing off stage to be optional.

A further discharge printing process is where the dyed fabric is printed with a specially formulated discharge ink containing pigments and pigment bonding agents, urea or a substituted urea and a discharging agent formulated so that the discharge effect is produced during a simple drying and baking operation designed to fix the pigment. Typical conditions for this kind of procedure may be provided by an oven operating at 190°–200° C. with a treatment time of 1–2 minutes. This procedure requires no steaming or washing off and is particularly advantageous for printing garments or garment panels, so-called "unit printing", as distinct from the printing of continuous web fabric which normally utilises any of the other above described procedures.

In the discharge printing of fabrics, for example cellulosic or substantially cellulosic fabrics, two kinds of discharging agents are typically used, both designed to effect destruction of the ground shade dye chromogen by reduction reactions. The most favoured are the metal salts of formaldehyde-sulphoxylic acid, of general formula $M(SO_2.CH_2.OH)N$, where M is a metal cation and N is the valency of the metal cation. These compounds are generally produced by reaction of formaldehyde with the appropriate metal sulphite, followed by reduction. Zinc, sodium and calcium salts are typically used. The zinc salt is particularly useful, especially when illuminated prints are to be produced since zinc formaldehyde-sulphoxylate has an acid reaction favourable to the curing of the acrylic binding agents generally used in such a process. Furthermore, reduction under mildly acid conditions generally favours the production of more weakly coloured degradation products from the discharge reactions than is obtained when using the alkaline sodium or calcium salts.

However, a serious disadvantage of using these discharging agents is that during the discharge reaction formaldehyde is liberated. While some of it escapes into the atmosphere, a high proportion is retained by the fabric. This residue of formaldehyde is readily removed by a washing off stage during fabric processing, but if the fabric is insufficiently washed after the printing process or washing off is omitted as, for example, during the procedure typically used in the so-called "unit printing" process described above, then significant amounts of formaldehyde, perhaps as much as 2000–3000 parts per million, will be present on the fabric. Formaldehyde is a known carcinogen and irritant and accordingly, fabric bearing such a residue may represent a health hazard or provide a skin sensitisation problem to those coming into contact with the fabric, such as those who work with the fabric to make garments or the first wearer of a garment made from the fabric.

An alternative, but less frequently used, discharging agent is thiourea dioxide which re-arranges under alkaline conditions to form formamidine sulphinic acid. Because of their isomeric relationship the descriptions thiourea dioxide and formamidine sulphinic acid are generally regarded as being synonymous and the term thiourea dioxide in the following may be regarded as embracing formamidine sulphinic acid unless otherwise stated. This, like zinc formaldehyde-sulphoxylate, breaks down during the discharge printing process to the highly reactive sulphoxylic acid, but neither contains nor produces any formaldehyde. However, because it has been generally regarded as an alkaline discharging agent producing, as a consequence, coloured discharge products, thiourea dioxide has limited use in discharge printing. In addition, it has been possible to use thiourea dioxide effectively only on processes involving steaming or in the presence of substantial amounts of non-volatile agents capable of acting as high temperature solvents or reaction media such as polyethylene glycols as described in the UK specifications 939515 and 1026236, as such conditions have, until now, been found necessary for the releasing of the active reaction products. Consequently, it has not been possible to use thiourea dioxide in procedures which do not utilise steam or where washing off undesirable residues is not possible, such as the "unit printing" procedure described above, notwithstanding the fact that it offers, potentially at least, a valuable alternative to zinc formaldehyde sulphoxylate because it leaves no formaldehyde containing residues on the unwashed printed fabric. The present invention addresses this problem by providing a formaldehyde free discharging agent which is effective in both dry heat and steam conditions.

GENERAL DESCRIPTION OF THE INVENTION

According to the present invention there is provided a process of decorating dyed fabrics comprising the steps of: applying a printing paste to desired image areas to form a design in the fabric, the printing paste containing at least one reagent capable of reacting with the dye in the fabric at least substantially to destroy its colour, the or one of the reagents being thiourea dioxide, and subjecting the applied paste to a treatment process for fixing the design in the fabric, characterised in that the printing paste also contains at least one finely dispersed calcium, magnesium or zinc hydroxide or components which, under the conditions of the treatment process, form such finely dispersed calcium, magnesium or zinc hydroxide and an amine.

The finely dispersed hydroxide may be produced in situ in the printing paste from a mixture of an amine or ammonia, together with at least one water soluble calcium, magnesium or zinc salt. The relative proportions are preferably stoichiometric or, preferably with an excess of amine or ammonia, though too great an excess should be avoided as unreacted amine or ammonia can lead to hinder curing problems. Alternatively, it may be produced by hydration of finely dispersed oxide in the presence of an alkali, for example an aliphatic amine or ammonia.

However, it is often preferred to use finely dispersed hydroxide in the printing paste as such, since this avoids the presence of alkaline electrolyte in the printing paste and reduces the risk of problems arising if electrolyte sensitive pigments, binders or thickeners are present in the paste.

In all cases, the amount of metal salt or other source of finely dispersed hydroxide should be sufficient to give adequate discharge properties to the print paste. Preferably the amount is sufficient to give a concentration in the print paste of at least 0.1 moles/liter, and a concentration of around 0.3 moles/liter of hydroxide has been found to give good results, with increased concentrations showing no material improvement.

The discharge printing paste used in carrying out the invention which contains, in addition to thiourea dioxide, the finely dispersed hydroxide, as such or produced in situ, can be used for the effective production of discharge effects under dry heat conditions as well as in procedures requiring steam treatment.

Preferred amines for use in the printing paste together with a calcium, magnesium or zinc salt, are aliphatic amines such as mono-ethanolamine, di-ethanolamine, tri-ethanolamine, mono-isopropanolamine and di-isopropanolamine. Monoethanolamine is most preferred as this is found to yield discharge products which are less coloured.

Any water soluble magnesium, calcium or zinc salt may be used such as a chloride, sulphate, nitrate or acetate. Acetates are generally preferred due to their weaker acid reaction and less deleterious effect than the other salts on thickening agents normally present to provide an ink of printable viscosity.

If the hydroxide is produced in situ during the treatment process, it is automatically produced in very finely dispersed form. If, as is preferred, it is present as such in the printing paste, it is preferably of particle size <7.5$\mu$. Such finely dispersed hydroxides may be added as an anhydrous powder or pre-dispersed in water when formulating the printing paste for a given fabric decorating run.

Preferably the printing paste contains agents for assisting the colour destroying reaction of the fabric dye and discharging agent, such as acids, alkalis, reduction catalysts and the like.

Depending on the effect desired, the printing paste may contain colouring materials which are chemically stable to the discharging agent(s), and which are capable of being fixed to the fabric during the process of the present invention. Generally these colouring materials are dispersed pigments. To assist this fixation, agents may be present such as resin binders which are capable of polymerising to bind the colouring materials to the fabric. Acrylic or polyurethane resin emulsions have been found to be most suitable for this purpose. Catalysts which promote the curing of the binder or binders may also be present in the printing paste.

Alternatively, discharge printed or decolorised image areas on the fabric may be overprinted with colouring materials to produce a design in a second printing step.

Other agents may be present in the discharge inks produced in accordance with the present invention to assist the printing process or enhance the properties of the printed fabrics. Examples include thickening agents, softening agents, flame proofing additives, wetting agents, and cross-linking agents.

The thickening agents may be derived from polyacrylic acid, polyurethanes, emulsified white spirit, materials derived from cellulose, guar gums, other carbohydrates or any other suitable material. Binding agents may be selected from the wide variety of binding agents available for the production of pigment prints on textiles as is the case also with regard to flame proofing or softening agents. Cross-linking agents include the condensation products of formaldehyde with urea, urea derivatives, melamine or triazones, as well as glyoxal and 2,2'-dimethoxy ethanol.

REFERRED MODES OF CARRYING OUT THE INVENTION

Examples of typical formulations and procedures in accordance with the present invention are given below:

Example 1

A printing paste is prepared containing (parts by weight):

| | |
|---|---|
| Acrylic polymer aqueous emulsion (Alcoprint PBA ex Allied Colloids Plc) | 18.0 |
| Urea | 12.0 |
| Hydroxymethyl cellulose (2.5% by weight aqueous Solution) | 14.0 |
| White spirit (as a 70% by weight aqueous emulsion) | 49.5 |
| Mono-ethanolamine | 1.5 |
| Zinc acetate | 5.0 |
| Copper phthalocyanine (as an aqueous dispersion) | 5.0 |
| Thiourea dioxide | 6.0 |

Alcoprint is a Registered Trade Mark.

A knitted garment panel dyed to a red shade using Remazol (Registered Trade Mark) Brilliant Red 3B (ex DyStar UK Ltd) is screen printed with a design using the above ink and then passed down a drying/curing oven operating at 200° C. with a total heating time of 2 minutes. The red shade is destroyed to leave a bright blue decoration which is fast to washing. If the mono-ethanolamine or the zinc acetate is omitted from the above recipe, the red shade is very poorly discharged and the decoration is of a dull and unsatisfactory shade.

If the printed areas of the fabric are tested for free formaldehyde using any of the standard tests approved by the British Standards Institute, the ISO or other recognised authority, the formaldehyde content is found to be <100 parts per million.

Example 2

A printing paste is prepared containing the following in parts by weight:

| | |
|---|---|
| Acrylic polymer aqueous emulsion (Alcoprint PBA ex Allied Colloids Plc) | 22.8 |
| Urea | 13.5 |
| White spirit (72% aqueous emulsion) | 52.1 |
| Hydroxymethyl cellulose (2.5% by weight aqueous Solution) | 11.5 |
| Monoethanolamine | 1.8 |
| Zinc hydroxide | 2.5 |
| Imperon Yellow K2G (DyStar UK Ltd) | 5.0 |
| Thiourea dioxide | 6.0 |

Imperon is a Registered Trade Mark.

A knitted garment panel dyed to a red shade using Remazol Brilliant Red 3B (DyStar UK Ltd) is screen printed with a design using the above ink and then passed down a drying/curing oven operating at 195° C. with a total heating time of 150 seconds. The red shade is destroyed to leave a bright yellow decoration which is fast to washing. If the zinc hydroxide is omitted from the above recipe, the red shade is very poorly discharged.

I claim:

1. A process of decorating a cellulose fabric of an original dye color by discharge printing to form a design on the fabric comprising 1) the steps of:

applying a paste in the design to the fabric, said paste comprising a reagent of at least one of thiourea dioxide or formamidine sulfinic acid 2) an amine and 3) calcium, magnesium or zinc hydroxides or water soluble metal salts or oxides of calcium, magnesium or zinc which, under the conditions of the treatment process, will react with ammonia or an amine to form finely dispersed hydroxides of the said metals; and dry heating the fabric with said paste thereon to react the constituents of the paste and discharge the original dye color.

2. A process according to claim 1 wherein the finely dispersed hydroxide is zinc hydroxide.

3. A process according to claim 1 wherein the hydroxide is formed in situ during the treatment process by reaction between a water soluble zinc, calcium or magnesium salt and ammonia or an amine.

4. A process according to claim 3 wherein the water soluble salt is a chloride, sulphate, nitrate or acetate.

5. A process according to claim 3 wherein the amine is mono-ethanolamine, di-ethanolamine, tri-ethanolamine or di-isopropanolamine.

6. A process according to claim 1 wherein the hydroxide is formed in situ by reaction between a finely dispersed oxide and an aliphatic amine or ammonia.

7. A process according to claim 6 wherein the amine is mono-ethanolamine, di-ethanolamine, tri-ethanolamine or di-isopropanolamine.

8. A process according to claim 1 wherein the printing paste further comprises coloring materials which are fixable in the fabric.

9. A process according to claim 8 wherein said coloring materials are pigments and said paste further comprises one or more resin binding polymers for fixing said pigments.

10. A process according to claim 2 wherein the hydroxide is formed in situ by reaction between a finely dispersed oxide and an aliphatic amine or ammonia.

11. A process according to claim 1 wherein said amine is an aliphatic amine.

12. A printing paste for use in the process of claim 1 wherein the paste comprises thiourea dioxide together with finely dispersed calcium, magnesium or zinc hydroxide or components which will react together to produce such finely dispersed hydroxide in situ.

13. The printing paste of claim 12 wherein the amount of hydroxide in the print paste, is such as to provide a concentration of hydroxide in the range of 0.1 to 0.3 moles/liter.

14. A fabric produced by the process of claim 1.

15. A process according to claim 2 wherein the hydroxide is formed in situ during the treatment process by reaction between a water soluble zinc salt and ammonia or an amine.

* * * * *